US006247290B1

(12) United States Patent
Kimmerle et al.

(10) Patent No.: US 6,247,290 B1
(45) Date of Patent: Jun. 19, 2001

(54) WALL FOR THE BOOTH OF A COATING PLANT

(75) Inventors: Walter Kimmerle, Holzgerlingen; Rainer Benzinger, Böblingen, both of (DE)

(73) Assignee: Eisenmann Maschinenbau KG (DE)

( * ) Notice: Subject to any disclaimer, the term of this patent is extended or adjusted under 35 U.S.C. 154(b) by 0 days.

(21) Appl. No.: 09/297,949

(22) PCT Filed: Jul. 20, 1998

(86) PCT No.: PCT/EP98/04523

§ 371 Date: May 10, 1999

§ 102(e) Date: May 10, 1999

(87) PCT Pub. No.: WO99/12656

PCT Pub. Date: Mar. 18, 1999

(30) Foreign Application Priority Data

Sep. 10, 1997 (DE) ..... 197 39 642

(51) Int. Cl.[7] ..... B05B 15/12; E04B 2/76

(52) U.S. Cl. ..... 52/775; 52/762; 52/766; 52/781; 52/481.2; 52/239

(58) Field of Search ..... 52/762, 766, 775, 52/781, 481.2, 220.7, 238.1, 239

(56) References Cited

U.S. PATENT DOCUMENTS

| | | | | |
|---|---|---|---|---|
| 2,643,170 | * | 6/1953 | Vanderveld et al. | 52/781 X |
| 2,881,877 | * | 4/1959 | Olsen | 52/762 X |
| 4,580,385 | * | 4/1986 | Field | 52/775 X |
| 4,619,091 | | 10/1986 | Gartner . | |
| 4,685,255 | * | 8/1987 | Kelley | 52/220.7 |
| 4,704,835 | * | 11/1987 | Jordan | 52/766 |
| 5,172,530 | * | 12/1992 | Fishel et al. | 52/239 X |
| 5,433,046 | * | 7/1995 | MacQuarrie et al. | 52/238.1 |
| 5,642,593 | * | 7/1997 | Shieh | 52/239 |
| 5,899,035 | * | 5/1999 | Waalkes et al. | 52/239 |
| 6,082,065 | * | 7/2000 | Feldpausch | 52/239 |

FOREIGN PATENT DOCUMENTS

| | | | | |
|---|---|---|---|---|
| 31 07 725 A1 | | 6/1982 | (DE) . | |
| 3202359 | * | 12/1982 | (DE) | 52/238.1 |
| 93 20 706 U | | 12/1994 | (DE) . | |
| 0 085 630 A1 | | 8/1983 | (EP) . | |

OTHER PUBLICATIONS

Internaional Search Report dated Dec. 1998.

* cited by examiner

*Primary Examiner*—Laura A. Callo

(57) ABSTRACT

A wall for the booth of a coating plant is formed in the conventional manner by a sectional frame (3) composed of at least two vertical, hollow posts (4, 5) and at least two horizontal, hollow crosspieces (6, 7, 8, 9). At least one zone (10, 11, 12) which is bounded by two posts (4, 5) and two crosspieces (6, 7, 8, 9) is covered by a plate (34, 35). The corresponding plate (34, 35) is secured over the associated zone (10, 11, 12) of the frame (3) with the aid of "local" blocking devices (15 to 27) separated from one another spatially. Each of these blocking devices (15 to 27) comprises at least one retaining portion (**31*b*, 31*c*) which can be inserted in a corresponding locating opening (28*a*, 28*b*, 29*a*, 29*b*) in the associated post (4, 5) or crosspiece (6, 7, 8, 9) such that a contact portion (31*a*) of the blocking device (15 to 27) lies against the outside of the associated post (4, 5) or crosspiece (6, 7, 8, 9). The plates (34, 35) are supported "locally" at these contact portions (31*a*) and are held in place in the lateral direction by a sectional frame (38) secured in a removable manner to the corresponding post (4, 5) or crosspiece (6, 7, 8, 9**).

5 Claims, 2 Drawing Sheets

WALL FOR THE BOOTH OF A COATING PLANT

The invention relates to a wall for the booth of a coating plant, comprising a) a frame consisting of at least two hollow vertical posts and at least two hollow horizontal crosspieces;

b) at least one plate, which covers a zone spanned by the posts and the crosspieces;

c) a securing device for each plate by means of which the plate is secured in a removable manner to the posts and crosspieces bounding the corresponding zone.

Walls of this kind may be composed of individual wall elements which each comprise two vertical posts and a plurality of horizontal crosspieces.

EP 0 647 476 A1 presents a wall of the type initially mentioned. In this case the securing device comprises a sectional strip, which is secured by screws to the adjacent section (crosspiece or post), at each side which bounds a zone. This sectional strip extends over the entire length of the zone and is provided with an undercut which cooperates with the bevelled edge of the plate. The arrangement is such that the sectional strip simultaneously serves as a positioning stop for the plate and as a device which holds the plate in place at the section. However the bevelling of the plate edges required for this is a very complex process; it is also complicated to form the sectional strips and secure them to the crosspieces and posts.

The object of the invention is to form a wall of the type initially mentioned such that the securing device for the plates has a simple structure and can easily be fixed to the associated posts and crosspieces.

This object is achieved according to the invention in that the securing device comprises:

d) a plurality of spaced blocking devices which each have at least one retaining portion and one contact portion;

e) a locating opening in a post or crosspiece for each retaining portion of each blocking device, wherein f) each retaining portion of each blocking device is introduced in a removable manner into a corresponding locating opening such that the contact portion lies against the outside of the associated post or crosspiece.

The invention therefore departs from the principle of supporting the edges of the plate which is to be secured in a zone over their entire length to achieve correct positioning. Instead the invention employs a plurality of discrete, "local" blocking devices which each only extend over a relatively short distance along the edge of the corresponding plate. Each of these blocking devices can quite easily be secured to the associated post or crosspiece by establishing a positive engagement, which holds the blocking device in place, by means of its retaining portion and the corresponding locating opening in the post or crosspiece. A plate is thus mounted on the frame formed by the posts and crossbars in the following manner: A suitable number of blocking devices are firstly inserted in the corresponding locating openings in the posts and crosspieces around each zone. The number of blocking devices is determined by the dimensions of the zone. The plate can then easily be set from the side between the different contact portions of the blocking devices, optionally with distance blocks being interposed; the plate is as a result correctly positioned inside the frame, but can still be moved towards the side. In order to take this last degree of freedom away from the plate, a corresponding sectional strip is placed over the edge region of the plate from the outside and suitably secured to the post or crosspiece.

Preference is generally given here to the formation in which each crosspiece which bounds the underside of a zone has two blocking devices which are associated with this zone, while the posts and crosspieces which bound this zone at the other three sides have just one blocking device in this region. This construction mode takes account of the fact that only the crosspiece which bounds the zone at the underside is loaded by the weight of the plate in the normal mounting position, while the blocking devices at the other three sides simply serve, unaffected by forces, to position the plate with respect to the zone. However the arrangement is still so stable that, if individual wall segments are pre-mounted, these may also be transported "flat" such that the posts, which normally stand vertically, lie horizontally.

The securing device according to the invention becomes particularly simple if each blocking device comprises a plane fixing sheet having as retaining portion at least one retaining lug which extends flatly and can be introduced into a locating opening formed as a slit-like oblong hole. A fixing sheet of this kind can be inexpensively produced as a stamped part or by numerically controlled laser cutting.

It is also expedient for each fixing sheet to have two spaced retaining lugs. The load is thus evenly distributed over the two retaining lugs without any significant torque acting on one of these retaining lugs, especially where relatively long fixing sheets and relatively heavy plates are concerned.

Preference is in turn given in this respect to the embodiment of the invention in which a slit extends from the side into each retaining lug such that, through the corresponding fixing sheet executing a lateral movement with respect to the vertical leg of the associated post or crosspiece, this sheet can be locked to the latter. Following this locking movement, a part of the retaining lug is located behind the material of the vertical leg of the corresponding post or crosspiece, so that the retaining lug can no longer be removed from the locating opening by pulling it perpendicularly to this leg.

If in this case the slit tapers in the shape of a wedge in the direction of its end lying inside the retaining lug, the fixing sheet can be correctly wedged in the leg of the corresponding post or crosspiece, for example by displacing the fixing sheet through blows from the side with a hammer until the material of the leg becomes wedged in the slit.

An embodiment of the invention is illustrated in detail in the following on the basis of the drawings, in which FIG. 1 is a diagrammatic, internal side view of a sectional frame which is part of the wall of a booth of a coating plant;

Figure 1:
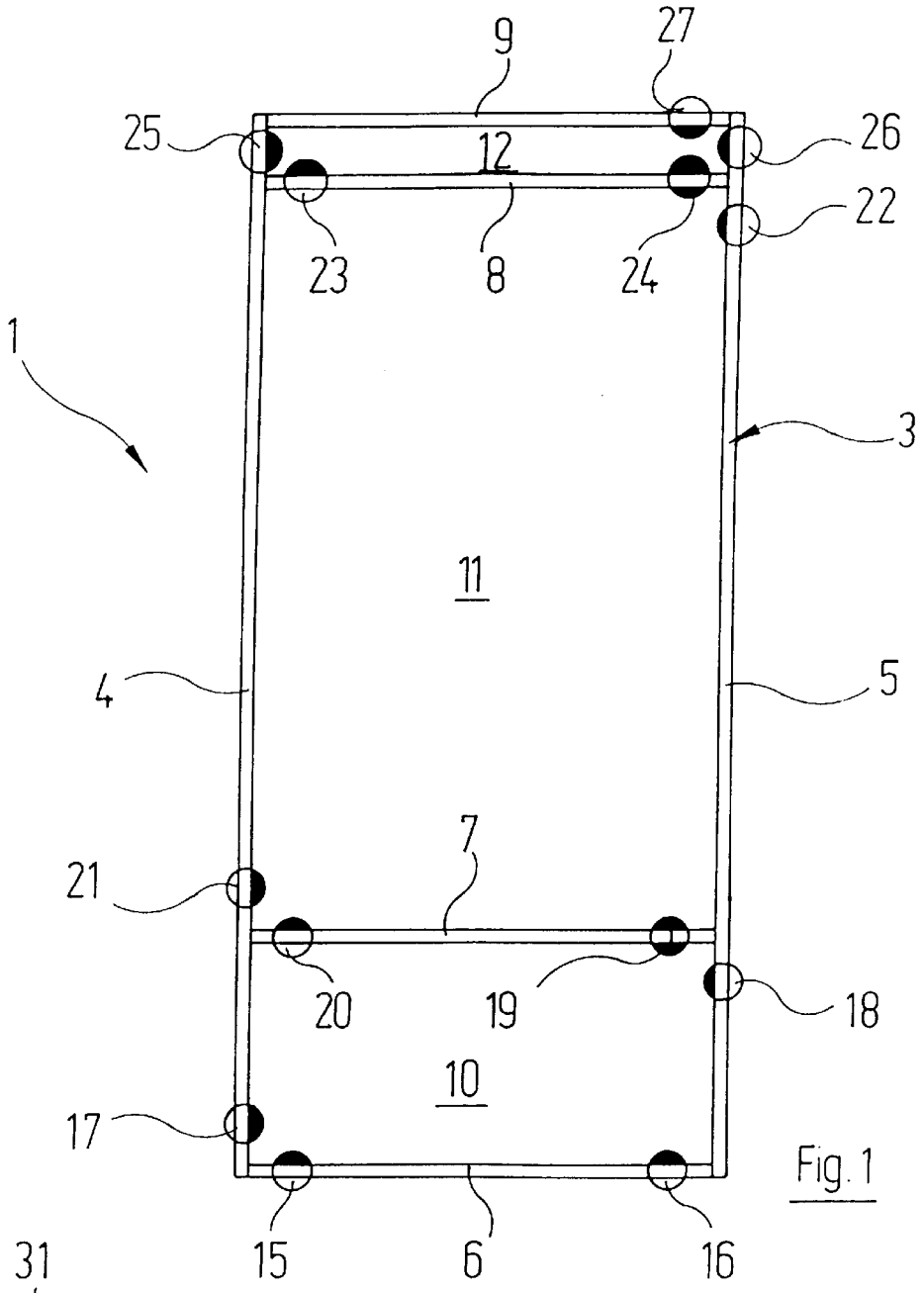
FIG. 1 shows an "unclad"wall element 1, which forms the wall of the booth of a coating plant, optionally with further identical wall elements adjoining on the left and the right.

The wall element 1 comprises, in a manner known per se, a sectional frame 3, which is spanned by two lateral vertical posts 4, 5 and, in the illustrated embodiment, four horizontal crossbars 6, 7, 8, 9. The zones 10, 11, 12 bounded by the posts 4, 5 and the crosspieces 6, 7, 8, 9 are closed by plates, these not being shown in FIG. 1, which are secured to the frame 3 as explained in detail in the following.

Figure 3:
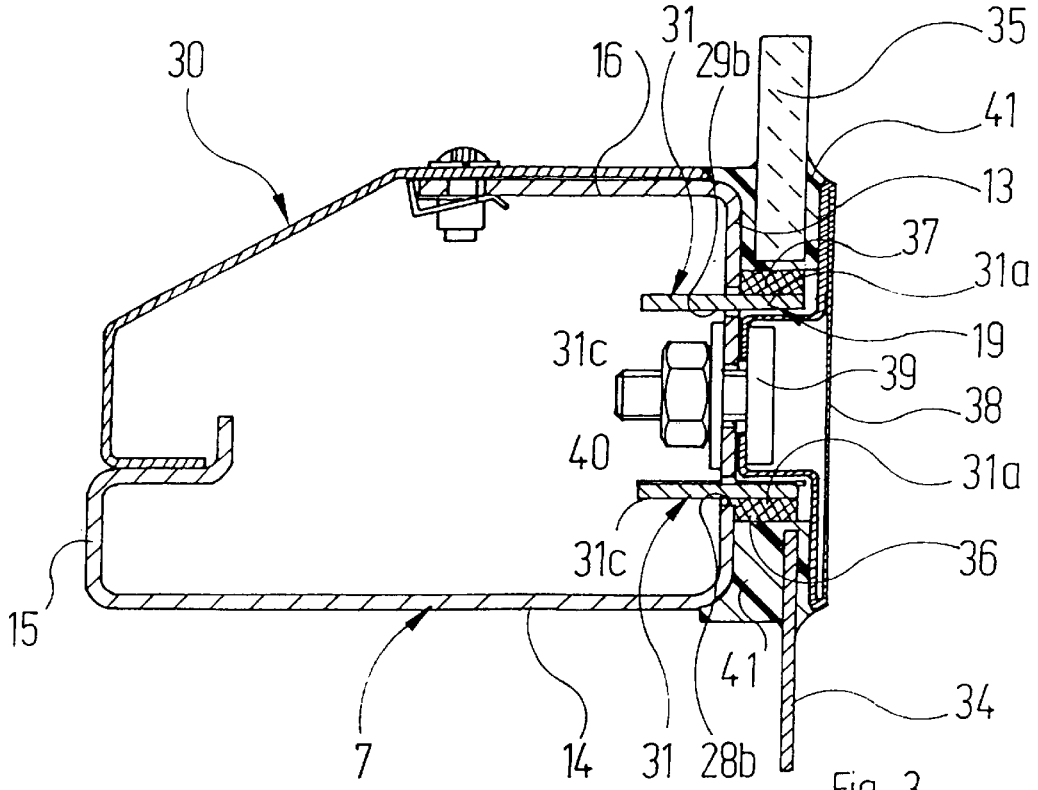
FIG. 3 is a scaled-up section through a crosspiece of the sectional frame of FIG. 1 with plates secured to this.

Both the vertically extending posts 4, 5 and the horizontal crosspieces 6, 7, 8, 9 of the sectional frame 3 consist of bent steel sheet, the structural shape of which can be seen in FIG. 3. This is a section whose basic geometric shape is a rectangle which, however, is not completely closed. The vertically extending sectional leg 13, to which the plate(s) of the adjacent zone or adjacent zones is or are secured, extends completely along the corresponding side of the rectangle, in the same way as one of the two legs which adjoins it, this being the lower leg 14 in FIG. 3. However the sectional leg 15, which adjoins the sectional leg 14 at a right angle and again extends upwards in FIG. 3, only extends over a part of the corresponding side of the rectangle, just like the sectional leg 16 adjoining the sectional leg 13 at a right angle at the top. A slit-shaped access opening to the interior of the section, in which certain fixtures and fittings not of particular interest here can be accommodated, thus remains between the free edges of the sectional legs 15 and 16.

The above-mentioned slit-shaped access opening is closed by a removable cover 30. The precise shape of the section of which the different posts 4, 5 and crosspieces 6, 7, 8, 9 consist is irrelevant in this connection; the important factor is that these are hollow sections which, contrary to the illustrated embodiment, may also be closed sections, e.g. extruded sections.

In order to secure the respective plates covering the zones 10, 11, 12 of the frame 3 of FIG. 1, the posts 4, 5 and the crosspieces 6, 7, 8, 9 are provided with "local" blocking devices 15 to 27 at the points marked symbolically with circles in FIG. 1. In this case a "local" blocking device is understood to mean a device which does not extend like a closed frame around a zone 10, 11, 12 of the sectional frame 3 and in this sense is "local". A typical extent of a "local" blocking device of this kind parallel to the direction of the corresponding post 4, 5 or crosspiece 6, 7, 8, 9 may lie in the range between 10 and 30 cm, preferably being approximately 25 cm. Here a "blocking" device is understood to mean each device at which the plates to be secured in the zones 10, 11, 12 can be supported in the lateral direction in order thus to find their correct position with respect to the elements of the frame 3. The plates can therefore be "set" from the side in these "blocking" devices 15 to 27 and then only require a "hold" on the side pointing outwards to prevent them falling out. This "hold" is explained in detail in the following with reference to FIGS. 2 to 4.

The symbolism which was used for the blocking devices 15 to 27 illustrated in FIG. 1 is intended to indicate the direction in which the corresponding blocking device acts. This "direction of action" is characterised in the respective circle which symbolises the blocking device by marking a corresponding circular segment black. For example, it can be deduced from FIG. 1 that the blocking devices 15, 16, 17, 18, 19 "act" in the direction of the zone 10. The blocking device 19 additionally acts in the direction of the zone 11. The plate which is to be secured in the zone 11 is therefore also supported by the blocking device 19 and, in addition to this, by the blocking devices 20, 21, 22 and 24. The blocking device 24 in turn additionally acts in the direction of the zone 12, with which the blocking devices 23, 25, 26 and 27 are also associated. The arrangement is such that each plate which is to be secured in a zone 10, 11, 12 is supported at its lower edge by two respective blocking devices 15, 16 or 19, 20 or 23, 24, while its other three sides are each retained just by one blocking device. This type of "blocking" is sufficient for all positions which the wall element may take up between production in the factory and mounting in situ: The wall element is generally produced in a flat position in the factory; it is transported from the factory to the mounting site with the posts 4, 5 of the wall element 1 horizontal, although the plane spanned by the sectional frame 3 is approximately vertical. The wall element 1 is finally erected in situ in the manner shown in FIG. 1, in which the posts 4, 5 extend vertically. As regards the type of blocking shown in FIG. 1, it is obvious that each plate is adequately fixed in the sectional frame 3 in all these possible positions.

Figure 2:
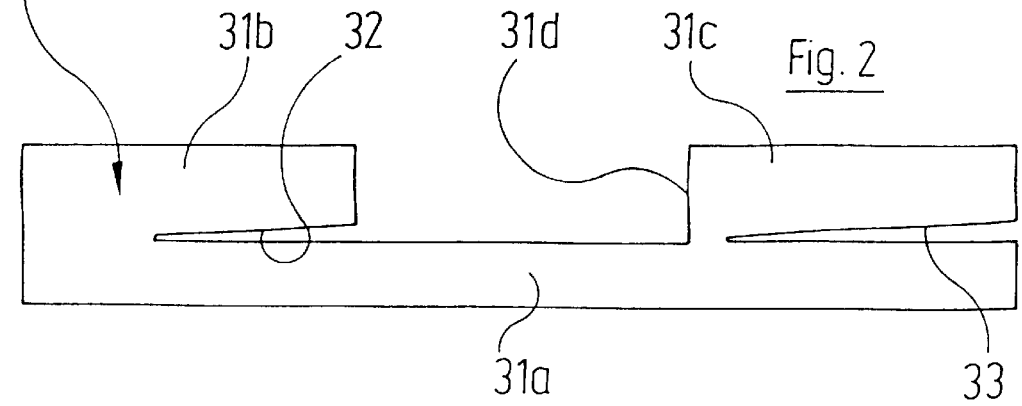
FIG. 2 is a scaled-up side view of a fixing sheet which is used to secure plates to the sectional frame of FIG. 1.
Figure 4:
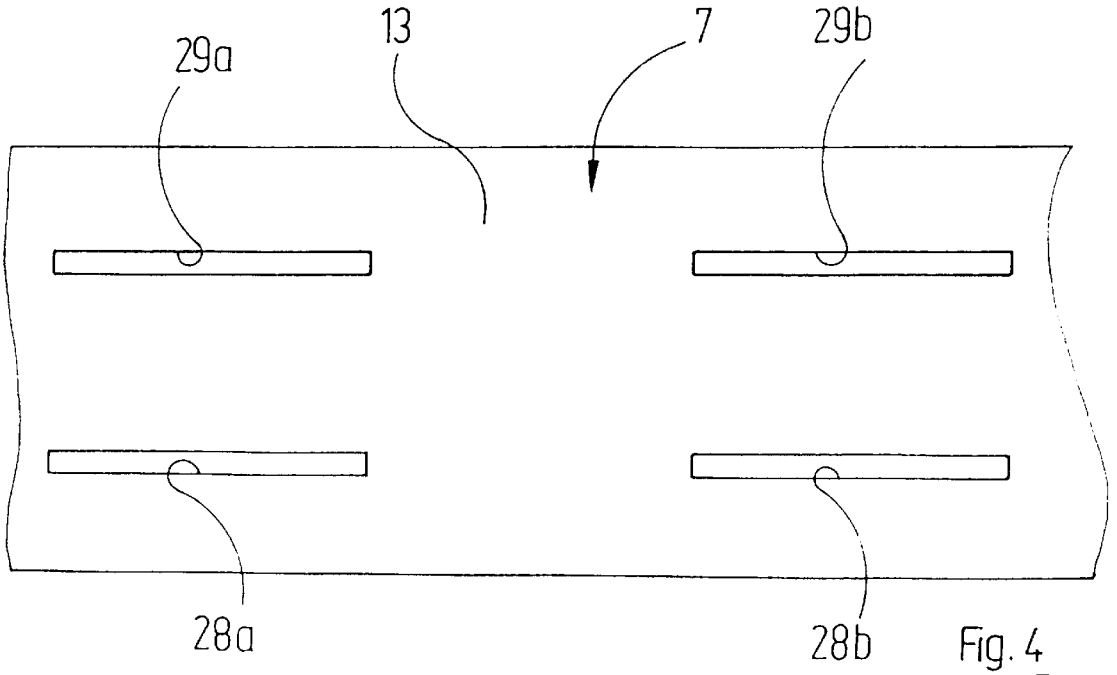
FIG. 4 is an external side view of the vertical leg of a crosspiece which is part of the sectional frame illustrated in FIG. 1.

FIGS. 2 to 4 show the exact structure of the blocking device 19 of FIG. 1.

FIG. 4 shows a detail of the vertically extending leg 13 of the crosspiece 7 in the region of the blocking device 19 of FIG. 1. A first slit-shaped pair of oblong holes 28*a*, 28*b* is made in the lower region of this leg 13, the individual slit-like oblong holes 28*a*, 28*b* being aligned with one another and their longitudinal extent running parallel with the longitudinal extent of the crosspiece 7. A second slit-like pair of oblong holes 29*a*, 29*b* is similarly provided in the upper region of the leg 13 of the crosspiece 7.

Each pair of oblong holes 28*a*, 28*b* and 29*a*, 29*b* serves to hold a fixing sheet as represented in a side view and marked with the reference number 31 in FIG. 2. The fixing sheet 31 is a plane sheet blank which can be produced by stamping or laser cutting. It comprises a strip-shaped contact portion 31*a*, which extends over the entire length of the fixing sheet 31, and two rectangular retaining lugs 31*b* and 31*c*, which are shaped at the ends of the contact portion 31*a*. The two retaining lugs 31*b* and 31*c* are separated from one another by a substantially rectangular recess 31*d*. A wedge-shaped slit 32 extends from the bottom of the recess 31*d*, forming a boundary of the contact portion 31*a*, into the retaining lug 31*b*, although does not pass completely through this. A second wedge-shaped slit 33 similarly extends from the right-hand end of the fixing sheet 31, in the geometric projection of the bottom of the recess 31*d*, into the right-hand retaining lug 31*c*, without passing completely through this.

The fixing sheet 31 represented in FIG. 2 can obviously be fixed as follows in one of the two pairs of oblong holes 28*a*, 28*b* and 29*a*, 29*b*, respectively: The retaining lugs 31*b* and 31*c* are firstly introduced into the two oblong holes 28*a*, 28*b* or 29*a*, 29*b*, which form part of a pair (the width of the retaining lugs 31*b* and 31*c* corresponds to the length of the oblong holes 28*a*, 28*b* and 29*a*, 29*b* ; the spacing between adjacent paired oblong holes 28*a*, 28*b* and 29*a*, 29*b* corresponds to the width of the recess 31*d* of the fixing sheet 31). When the bottom of the recess 31*d* of the fixing sheet 31 contacts the surface of the leg 13, the slits 32, 33 of the fixing sheet 31 are aligned with the sheet 35 material of which the leg 13 of the crosspiece 7 consists. The fixing sheet 31 can therefore now be driven to the side, optionally with the aid of a hammer, such that the material region of the leg 13 lying between the oblong holes 28*a*, 28*b* or 29*a*, 29*b* enters the slit 32 and a material region of the leg 13 lying next to the oblong holes 28*b*, 29*b* accordingly enters the slit 33. Because of the wedge-shaped formation of the slits 32 and 33, the fixing sheet 31 is wedged in the position represented in FIG. 3. In this position the retaining portion 31*a* projects outwards beyond the leg 13 of the crosspiece 7, while the retaining lugs 31*b*, 31*c* extend into the interior of the hollow section from which the crosspiece 7 is formed.

As has already been explained, the blocking device 19 represented in FIG. 3 acts in two directions. Therefore, where this blocking device is concerned, a fixing sheet 31 is inserted both in the upper pair of oblong holes 29*a*, 29*b* and in the lower pair of oblong holes 28*a*, 28*b*. The blocking device 24 is also set up in a corresponding manner in the crosspiece 8 of the sectional frame 3 (cf. FIG. 1).

However just one fixing sheet 31 is used for all the other blocking devices 16 to 18 and 20 to 23 and 25 to 27, this sheet being introduced into the pair of oblong holes 28*a*, 28*b* or 29*a*, 29*b* which points towards the plate to be secured. Generally speaking, it would also be possible to provide just one pair of oblong holes 28*a*, 28*b* or 29*a*, 29*b* in the corresponding frame part 4 to 9 for these last mentioned blocking devices 15 to 18 and 20 to 27.

As also shown by FIG. 3, the contact region 31*a* of the fixing sheets 31 which are introduced into the leg 13 of the crosspiece 7 serves to support the plates which are to be secured to the zones 10, 11 adjacent to the crosspiece 7. For illustration purposes it was assumed in FIG. 3 that the zone 10 below the crosspiece 7 is covered by a metal plate 34, while the zone 11 located above the crosspiece 7 is covered by a glass plate 35. The edge of these plates 34 and 35, respectively, lies against the corresponding contact portion 31*a* of the associated fixing sheet 31 via a block 36 and 37, respectively, of an appropriate material rather than directly.

As already mentioned, after having been inserted between the different blocking devices, the plates 34 and 35 still require a lateral hold. This is provided in the embodiment of FIG. 3 by a double-acting retaining section 38, which laps over both the metal plate 34 and the glass 35 and is secured to the leg 13 of the crosspiece 7 by means of T bolts 39 and corresponding nuts 40. The space between the leg 13, the blocks 36 and 37 and the overlapping regions of the retaining section 38 is in each case filled with an elastic sealing material 41 such that the adjacent edge regions of the plates 34 and 35 are embedded in this sealing compound 41.

What is claimed is:

1. Wall for the booth of a coating plant, comprising a) a frame consisting of at least two hollow vertical posts and at least two hollow horizontal crosspieces;

b) at least one plate, which covers a zone spanned by the posts and the crosspieces;

c) a securing device for each plate by means of which the plate is secured in a removable manner to the posts and crosspieces bounding the corresponding zone, characterised in that the securing device comprises:

d) a plurality of spaced blocking devices (15 to 27) which each have at least one retaining portion (31*d*, 31*c*) and one contact portion (31*a*);

e) a locating opening (28*a*, 28*b*, 29*a*, 29*b*) in a post (4, 5) or crosspiece (6, 7, 8, 9) for each retaining portion (31*b*, 31*c*) of a blocking device (15 to 27); wherein f) each retaining portion (31*b*, 31*c*) of each blocking device (15 to 27) is introduced in a removable manner into a corresponding locating opening (28*a*, 28*b*, 29*a*, 29*b*) such that the contact portion (31*a*) lies against the outside of the associated post (4, 5) or crosspiece (6, 7, 8, 9), and g) each crosspiece (6, 7, 8) which bounds the underside of a zone (10, 11, 12) has two blocking devices (15, 16, 19, 20, 23, 24) which are associated with this zone (10, 11, 12), while the posts (4, 5) and crosspieces (7, 8, 9) which bound this zone (10, 11, 12) at the other three sides have just one blocking device (17, 18, 21, 22, 25, 26, 27) in this zone.

2. Wall according to claim 1, wherein said locating opening is formed as a slit-like oblong hole, characterised in that each blocking device (15 to 27) comprises a plane fixing sheet (31) having as retaining portion at least one retaining lug (31*b*, 31*c*) which extends flatly and can be introduced into the locating opening (28*a*, 28*b*, 29*a*, 29*b*).

3. Wall according to claim 2, characterised in that each fixing sheet (31) has two spaced retaining lugs (31*b*, 31*c*).

4. Wall according to claim 2, characterised in that a slit (32, 33) extends from a side of the fixing sheet (31) into each retaining lug (31*b*, 31*c*) such that, through the corresponding fixing sheet (31) executing a lateral movement with respect to a vertical leg (13) of the associated post (4, 5) or crosspiece (6, 7, 8, 9), this sheet can be locked to the latter.

5. Wall according to claim 4, characterised in that the slit (32, 33) tapers in the shape of a wedge in the direction of an end of the slit lying inside the retaining lug (31*b*, 31*c*).

* * * * *